US007432895B2

(12) United States Patent
Mi

(10) Patent No.: US 7,432,895 B2
(45) Date of Patent: Oct. 7, 2008

(54) DRIVE FOR ACTIVE MATRIX CHOLESTERIC LIQUID CRYSTAL DISPLAY

(75) Inventor: Xiang-Dong Mi, Rochester, NY (US)

(73) Assignee: Industrial Technology Research Institute, Hsinchu (TW)

( * ) Notice: Subject to any disclaimer, the term of this patent is extended or adjusted under 35 U.S.C. 154(b) by 744 days.

(21) Appl. No.: 10/677,764

(22) Filed: Oct. 2, 2003

(65) Prior Publication Data

US 2005/0073491 A1 Apr. 7, 2005

(51) Int. Cl.
*G09G 3/36* (2006.01)

(52) U.S. Cl. ..... 345/87; 345/94; 345/98; 345/100; 345/97

(58) Field of Classification Search ..... 345/87–89, 345/50, 32, 591, 691–696, 100, 94–98, 204, 345/214, 107, 82, 581; 313/310, 495; 349/109; 315/169.3; 445/24; 709/224
See application file for complete search history.

(56) References Cited

U.S. PATENT DOCUMENTS 4,716,403 A * 12/1987 Morozumi ..... 345/88
4,743,096 A * 5/1988 Wakai et al. ..... 345/89
5,185,602 A * 2/1993 Bassetti et al. ..... 345/89
5,280,280 A * 1/1994 Hotto ..... 345/94
5,745,087 A * 4/1998 Tomiyoshi et al. ..... 345/89
5,777,590 A * 7/1998 Saxena et al. ..... 345/89
6,394,870 B1 * 5/2002 Petruchik et al. ..... 445/24
6,421,031 B1 * 7/2002 Ronzani et al. ..... 345/8
6,423,368 B1 7/2002 Stephenson et al.
6,518,944 B1 * 2/2003 Doane et al. ..... 345/87
6,614,491 B2 * 9/2003 Hasegawa et al. ..... 349/37
6,629,138 B1 * 9/2003 Lambert et al. ..... 709/224
6,710,760 B1 * 3/2004 Johnson et al. ..... 345/94
6,894,668 B2 * 5/2005 Mi et al. ..... 345/87
6,999,050 B2 * 2/2006 Hung et al. ..... 345/87
7,012,600 B2 * 3/2006 Zehner et al. ..... 345/214
7,119,772 B2 * 10/2006 Amundson et al. ..... 345/87
7,164,406 B2 * 1/2007 Lee ..... 345/94
7,170,481 B2 * 1/2007 Doane et al. ..... 345/87
7,193,625 B2 * 3/2007 Danner et al. ..... 345/214

(Continued)

OTHER PUBLICATIONS

Nahm et al., Amorphous Silicon Thin-Film Transistor Active-Matrix Reflective Cholesteric Liquid Crystal Display, *ASIA Display*, 1998, pp. 979-982.

(Continued)

*Primary Examiner*—Prabodh Sharia
(74) *Attorney, Agent, or Firm*—Alston & Bird LLP

(57) ABSTRACT

A method of driving an active matrix cholesteric liquid crystal display that includes a matrix of data and select lines and an array of pixels connected to the data and select lines through active switching elements, a pixel being capable of producing two or more gray levels includes providing a select voltage and a plurality of data voltages, and during a pixel writing cycle, applying the select voltage and the data voltages to the select and data lines of the display to produce only three pixel voltage levels 0, +U and −U, having respective duty cycles and controlling the duty cycles of the pixel voltage levels to determine the gray levels of the pixels, and wherein the average voltage applied to a pixel during the pixel writing cycle is zero.

12 Claims, 8 Drawing Sheets

U.S. PATENT DOCUMENTS

| | | | | |
|---|---|---|---|---|
| 2001/0050666 | A1 | 12/2001 | Huang et al. | |
| 2002/0005831 | A1* | 1/2002 | Ishii | 345/89 |
| 2002/0186182 | A1* | 12/2002 | Stephenson et al. | 345/50 |
| 2002/0190923 | A1* | 12/2002 | Ronzani et al. | 345/50 |
| 2003/0034945 | A1* | 2/2003 | Mi et al. | 345/89 |
| 2003/0128218 | A1* | 7/2003 | Struyk | 345/581 |
| 2003/0137521 | A1* | 7/2003 | Zehner et al. | 345/589 |
| 2003/0206147 | A1* | 11/2003 | Mi et al. | 345/87 |
| 2005/0001812 | A1* | 1/2005 | Amundson et al. | 345/107 |
| 2005/0024353 | A1* | 2/2005 | Amundson et al. | 345/204 |
| 2005/0083284 | A1* | 4/2005 | Huang et al. | 345/88 |
| 2005/0219184 | A1* | 10/2005 | Zehner et al. | 345/89 |
| 2006/0050032 | A1* | 3/2006 | Gunner et al. | 345/82 |
| 2006/0139310 | A1* | 6/2006 | Zehner et al. | 345/107 |
| 2006/0139311 | A1* | 6/2006 | Zehner et al. | 345/107 |
| 2006/0232531 | A1* | 10/2006 | Amundson et al. | 345/87 |
| 2006/0267896 | A1* | 11/2006 | Edwards | 345/94 |

OTHER PUBLICATIONS

Kawata et al., A High Reflective LCD with Double Cholesteric Liquid Crystal Layers, *Proceedings of the 17th International Display Research Conference*, 1997, pp. 246-249.

Rybalochka et al., Dynamic Drive Scheme for Fast Addressing of Cholesteric Displays, *SID 2000*, pp. 818-821.

Rybalochka et al., Simple Drive Scheme for Bistable Cholesteric LCDs, *SID 01 Digest*, pp. 882-885.

* cited by examiner

DRIVE FOR ACTIVE MATRIX CHOLESTERIC LIQUID CRYSTAL DISPLAY

FIELD OF THE INVENTION

The present invention relates to a drive for an active matrix cholesteric liquid crystal display.

BACKGROUND OF THE INVENTION

It is well known that cholesteric (also referred as chiral nematic) liquid crystal displays have optically distinct states: a planar state that reflects light, a focal conic state, and a homeotropic state that appears black if a black layer is painted on one side of the display. In the following, the planar state is also referred as the on-state, and the focal conic state as the off-state. Both the planar and the focal conic states are stable at zero voltage. The homeotropic state can only be maintained with a voltage applied across the display. Thus using the planar and focal conic states, cholesteric liquid crystal displays can be advantageously addressed by a passive matrix for many applications.

However, passive matrix addressed cholesteric liquid crystal displays have problems such as cross-talk, long frame times, and black bar artifacts. These problems can be overcome by driving the displays with an active matrix drive scheme at the higher expense of the active matrix. With the intense research and development of amorphous and poly silicon thin film transistors, active matrix drive appears to be affordable for use in high performance cholesteric liquid crystal displays. Organic thin film transistors fabricated on plastic substrates offer higher voltage outputs (e.g. 100 volts or more) that can be used to drive liquid crystal displays that require a high drive voltage.

A typical active matrix pixel drive is shown in FIG. 1 and includes a matrix of data 10 and select 12 lines. Data and select lines are also called column and row lines, respectively. An array of pixels 14 are connected to the data and select lines through active switching elements that in one example include a transistor 16 and a storage capacitor 18. The active matrix addressed liquid crystal display further includes a common electrode 20 connected to all of the pixels.

Nahm et al., Amorphous Silicon Thin-Film Transistor Active-Matrix Reflective Cholesteric Liquid Crystal Display, *Proceedings of the* 18*th International Display Research Conference*, pp. 979-982, 1998, and Kawata et al., A High Reflective LCD with Double Cholesteric Liquid Crystal Layers, *Proceedings of the* 17*th International Display Research Conference*, pp. 246-249, 1997, proposed active matrix addressed bistable cholesteric liquid crystal displays that were operated between the planar and homeotropic states.

US 2001/050666 A1 issued Dec. 13, 2001 to Huang et al. discloses active matrix addressed bistable cholesteric liquid crystal displays that made better use of the bistability of the cholesteric liquid crystal display and were operated between the planar and focal conic states. They propose driving the active matrix addressed bistable cholesteric liquid crystal displays by a multiple level voltage driver that supplies two voltage levels (+40 volts, −40 volts) to achieve the planar state, and another two voltage levels (+30 volts, −30 volts) to obtain the focal conic state.

As shown in FIG. 2, Huang et al. employ row, column, backplane, and pixel voltage waveforms varying with time t in two consecutive frames. Without loss of generality, two row voltage waveforms (also referred as select voltage waveforms) $V_{row1}$, $V_{row2}$ and two column voltage waveforms (also called data voltage waveforms) $V_{col1}$, $V_{col2}$ are used to illustrate the idea. In the first frame 30, a select voltage pulse 200 is sequentially applied to row 1 and row 2. In the meantime, data voltage waveforms $V_{col1}$, $V_{col2}$ are applied to column 1 and column 2. Note that the data voltage waveforms take different amplitudes in order to achieve distinct optical states. In particular, a voltage pulse of 40 volts is applied to obtain a planar state, and a pulse of 30 volts to obtain a focal conic state. The backplane is connected to zero voltage. The row voltage for selection is preferably about 5 V and, most preferably, at least 5 V higher than column voltage, in order to open or close the transistor 16. The pixel voltage $V_{P11}$ formed at the intersection of row 1 and column 1 thus is 40 volts, and the pixel voltage $V_{P22}$ formed at the intersection of row 2 and column 2 is 30 volts.

In the second frame 32, the backplane is set at 40 volts. The data voltage is zero for the planar state, and 10 volts for the focal conic state. The pixel voltage is then either −40 volts for $V_{P11}$, 0 volts for $V_{P12}$, or −30 volts for $V_{P22}$. The zero pixel voltage $V_{P12}$ keeps the state of the pixel unchanged.

Overall, in the prior art active matrix addressed cholesteric liquid crystal displays, more than 2 different voltage levels in addition to a zero level are required to apply to data voltage waveforms and pixel voltage waveforms. This complexity hinders the use of the active matrix to address cholesteric liquid crystal displays.

It is well known that fewer voltage level drivers would result in a lower cost. A two level voltage driver has been utilized for a passive matrix cholesteric liquid crystal display, such as disclosed by Rybalochka et al., Dynamic Drive Scheme for Fast Addressing of Cholesteric Displays, SID 2000, pp. 818-821 and Simple Drive Scheme for Bistable Cholesteric LCDs, SID 2001, pp. 882-885. They proposed $U/\sqrt{2}$ and $U/\sqrt{3/2}$ dynamic driving schemes requiring only 2-level column and row drivers, which output either U or 0 voltage, to generate a 3-level pixel voltage including +U, −U, and 0. The passive matrix 3-level drive schemes employ multiple phases, including preparation, holding, selection, and evolution phases. Since active matrix displays do not employ multiple phases as discussed in the above cited papers, it is not apparent whether or how a 3-level drive scheme could be used with an active matrix to obtain the inherent advantages of a 3-level drive scheme.

Therefore, there is a need for an improved drive scheme for an active matrix addressed cholesteric liquid crystal display having fewer voltage levels to reduce complexity of the drive scheme while achieving high optical performance.

SUMMARY OF INVENTION

The need is met according to the present invention by providing a method of driving an active matrix cholesteric liquid crystal display that includes a matrix of data and select lines and an array of pixels connected to the data and select lines through active switching elements, a pixel being capable of producing two or more gray levels. The method includes providing a select voltage and a plurality of data voltages, and during a pixel writing cycle, applying the select voltage and the data voltages to the select and data lines of the display to produce only three pixel voltage levels 0, +U and −U, having respective duty cycles and controlling the duty cycles of the pixel voltage levels to determine the gray levels of the pixels, and wherein the average voltage applied to a pixel during the pixel writing cycle is zero.

DETAILED DESCRIPTION OF THE INVENTION

The present description is directed in particular to elements forming part of, or cooperating more directly with, apparatus and methods in accordance with the invention. It is to be understood that elements not specifically shown or described may take various forms well known to those skilled in the art.

Figure 5:
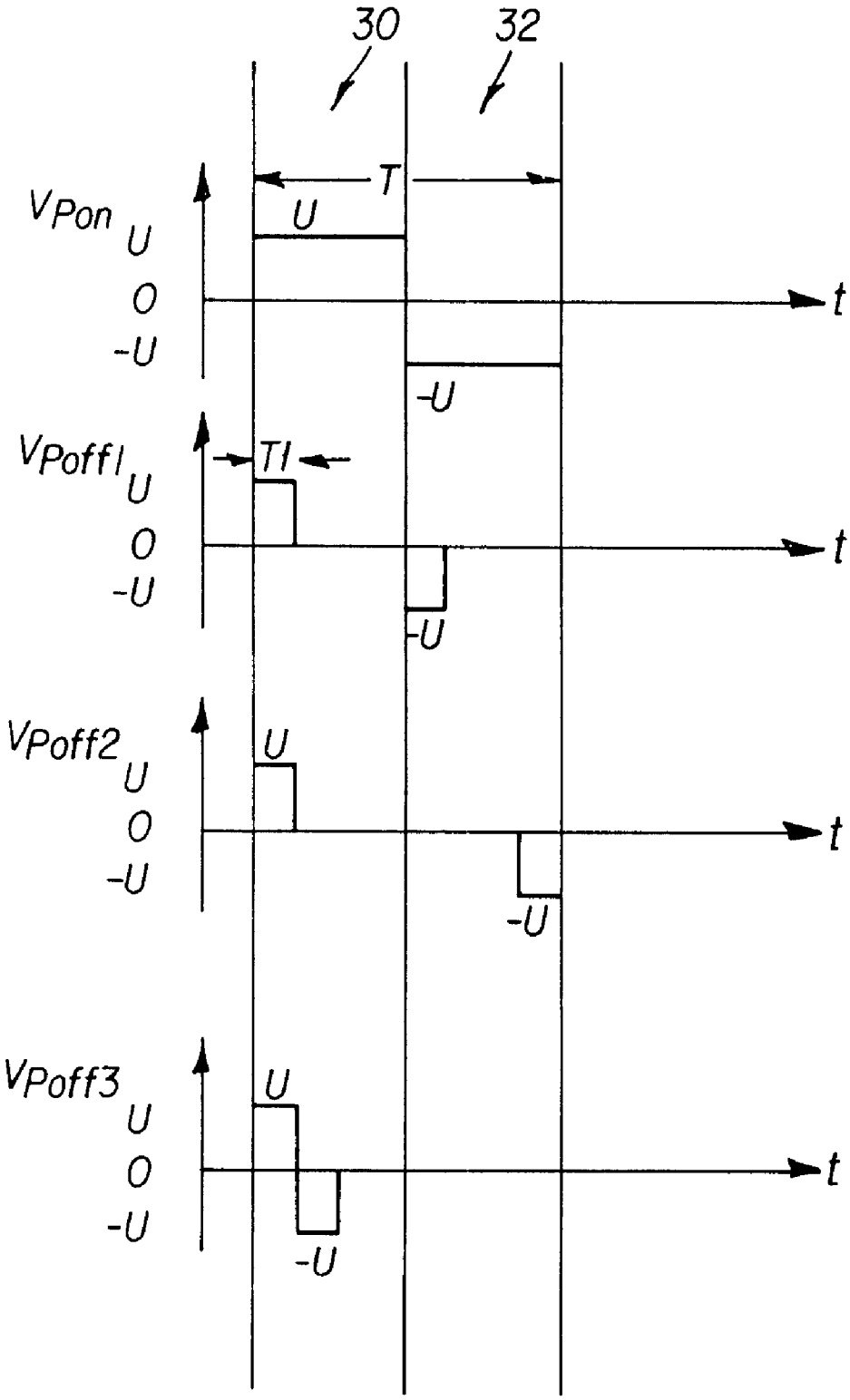
FIG. 5 is a pixel voltage waveform resulting from the drive scheme of FIGS. 4A and 4B.

Referring to FIG. 5, a single repetitive unit having only three levels 0, +U, and −U in two frames 30 and 32 is used to generate pixel voltage waveforms according to the present invention. The waveforms can be used to drive cholesteric liquid crystals into various states by providing respective duty cycles and controlling the duty cycles of the pixel voltage levels to determine the final states that result in the gray levels of the display. The on-state and off-sate pixel voltage waveforms switch the pixel into final planar and focal conic states, respectively. In one example, the on-state pixel voltage waveform $V_{Pon}$ has 100% duty cycle, being +U in the first frame 30, and −U in the second frame 32. To minimize the amplitude of U, $V_{Pon}$ is preferred to have a duty cycle close or equal to 100%. The off-state pixel voltage waveform has a duty cycle determined by 2T1/T, where T is the period of the waveform, and 2T1 is the total time for the voltage level to be at ±U in a single repetitive unit. As shown, the off-state pixel voltage waveform may take various forms including but not limited to $V_{Poff1}$, $V_{Poff2}$, or $V_{Poff3}$, each of which has a duty cycle determined by experimental data. A typical usable duty cycle for the off-state is between 20% to 50%. In either case, the average voltage applied to a pixel during a single repetitive unit and thus the full pixel writing cycle (which includes one or more repetitive units) is zero.

By properly choosing voltage level U, period T (or frequency 1/T), and number of the repetitive units, experimental data generated by the inventor, show that it is possible to use the simplified pixel voltage waveforms having only 0, +U, and −U, for active matrix addressed cholesteric liquid crystals.

Figure 6:
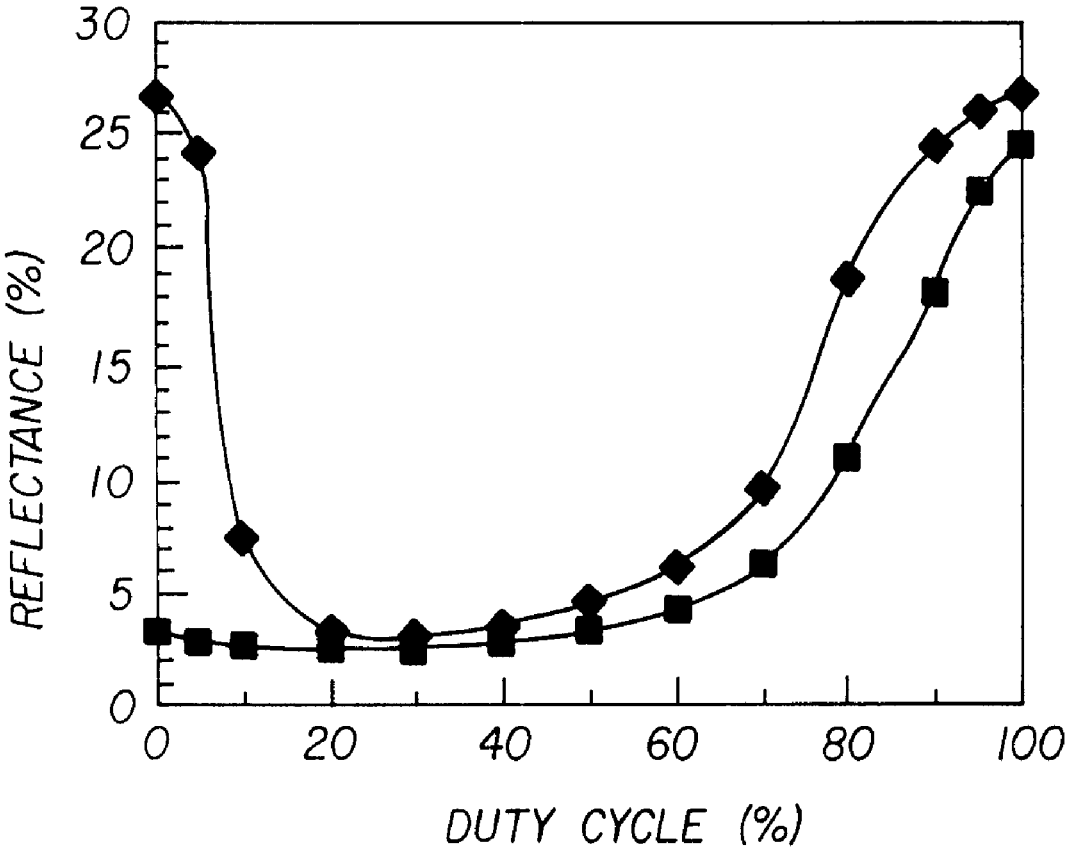
FIG. 6 is experimental data showing the reflectance response of a cholesteric liquid crystal display to the pixel voltage shown in FIG. 5.

Referring to FIG. 6, the duty cycle dependence of the reflectance of a cholesteric liquid crystal display at the peak wavelength is plotted. The curves through the diamonds and squares correspond to the initial states being the planar and focal conic states, respectively. The data shows that at a high duty cycle from 90% to 100%, the first optical state with high reflectance can be achieved, and at a lower duty cycle from 20% to 50%, the second optical state with lower reflectance can be achieved. The display sample was made according to the method disclosed in U.S. Pat. No. 6,423,368 issued Jul. 23, 2002 to Stephenson et al., which is incorporated herein by reference. The voltage U used in the experiment was 120 volts, mainly determined by the thickness and composition of the liquid crystal layer. The liquid crystal material was dispersed in a polymer binder such as gelatin that did not respond to an electric field. The thickness of the liquid crystal layer was about 9 microns. It is possible that a cholesteric liquid crystal display with less polymer, or without polymer, would have a reflectance response to the duty cycle at a lower voltage level U similar to that shown in FIG. 6. Though the voltage level U is high (around 120 volts) in the example shown in FIG. 5, a driver can be implemented by organic thin film transistors. In addition, a low voltage liquid crystal display with a maximum voltage around 40 volts as disclosed in US 2001/050666 A1 issued Dec. 13, 2001 to Huang et al., can be addressed by the drive schemes disclosed in the present invention.

Figure 1:
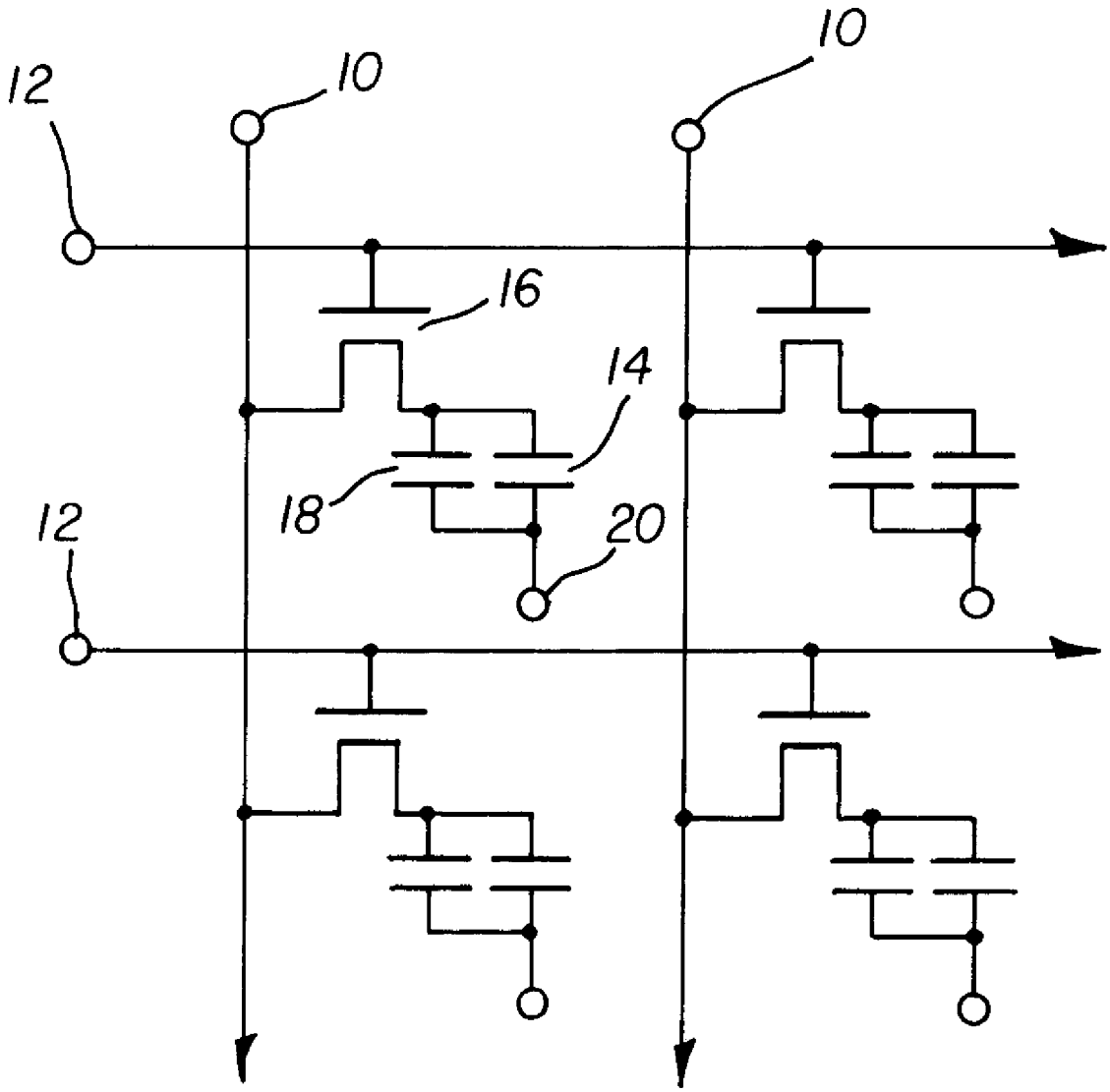
FIG. 1 (Prior Art)
FIG. 1 is a schematic circuit diagram of a typical prior art active matrix drive.
Figure 2:
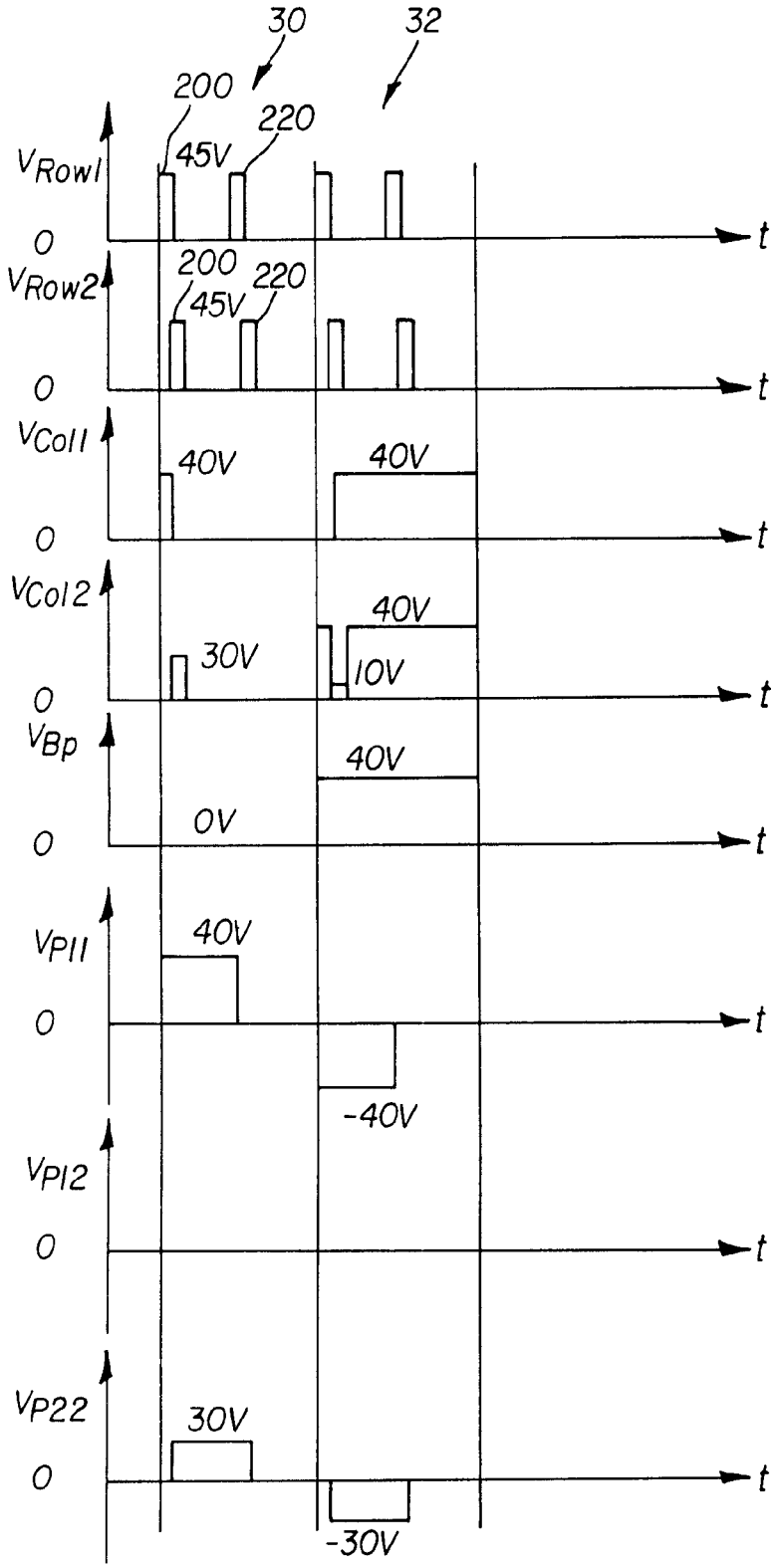
FIG. 2 (Prior Art)
FIG. 2 is a voltage waveform diagram for driving an active matrix cholesteric liquid crystal display according to the prior art.
Figure 3A:
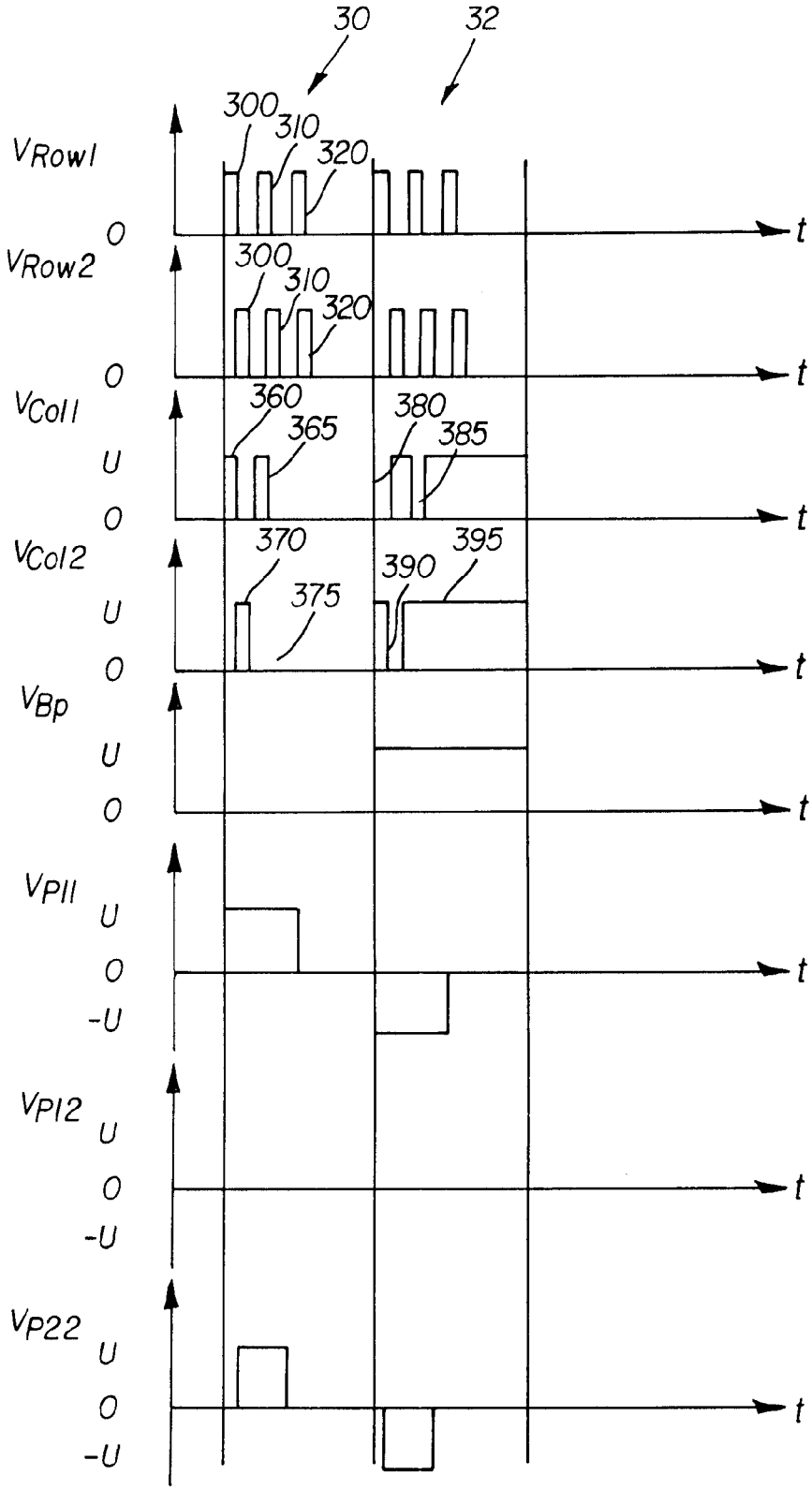
FIG. 3A is a voltage waveform diagram for driving an active matrix cholesteric liquid crystal display according to the present invention.

Based on the experimental study, the present invention proposes a new active matrix addressed cholesteric liquid crystal display drive scheme that reduces the complexity of the prior art drive schemes. Referring to FIG. 3A, in the first frame 30, a zero voltage is applied to the common electrode so that the backplane voltage $V_{Bp}$ is zero. Row 1 and Row 2 receive select voltage waveforms $V_{Row1}$ and $V_{Row2}$, respectively. The absolute level of the row voltages are not critical, and merely need to be sufficient to drive the transistor 16. Like the discharge voltage pulse 220 in the prior art scheme shown in FIG. 2, the present invention provides a discharge voltage pulse 320. The discharge voltage pulse 320 discharges the pixel to zero voltage relative to the backplane voltage. However, in the present invention there are a plurality of select voltage pulses in addition to the discharge voltage pulse in a single frame. As shown in FIG. 3A, the select waveforms $V_{Row1}$ and $V_{Row2}$ have at least two select voltage pulses 300 and 310. The first select voltage pulse 300 is a selection portion to select a line to be addressed, and the second select voltage pulse 310 is a duty cycle portion wherein the duty cycle of the non zero pixel voltages are determined. Similarly, there are two data voltage pulses 360 and 365 for the first optical (planar) state, and two data voltage pulses 370 and 375 for the second optical (focal conic) state. In particular, the first data voltage pulses 360 and 370 are identical having the same amplitude of +U for both the first and second states. It is the second data voltage pulse 365 or 375 that dictates the final state. When the second data voltage pulse has the same amplitude of +U, the pixel voltage $V_{P11}$ has a larger duty cycle. However, when the second data voltage pulse has an amplitude of 0, the pixel voltage $V_{P22}$ has a smaller duty cycle. In either case, the pixel voltage is +U or 0 in the first frame.

In the second frame 32, a non-zero voltage +U is applied to the common electrode, thus the backplane voltage $V_{Bp}$ is +U. The select voltages $V_{Row1}$ and $V_{Row2}$ are the same as those having a selection portion and a duty cycle portion in the first frame. The data voltage waveforms still have two data voltage pulses 380 and 385 for the first optical (planar) state, and two data voltage pulses 390 and 395 for the second optical (focal conic) state, with the first data voltage pulses 380 and 390 being the same as 0, and the second data voltage pulses being either 0 like data voltage pulse 385 for the planar state, or +U like the data voltage pulse 395 for the focal conic state. Unlike in the first frame, the pixel voltage is either −U or 0 in the second frame.

Figure 3B:
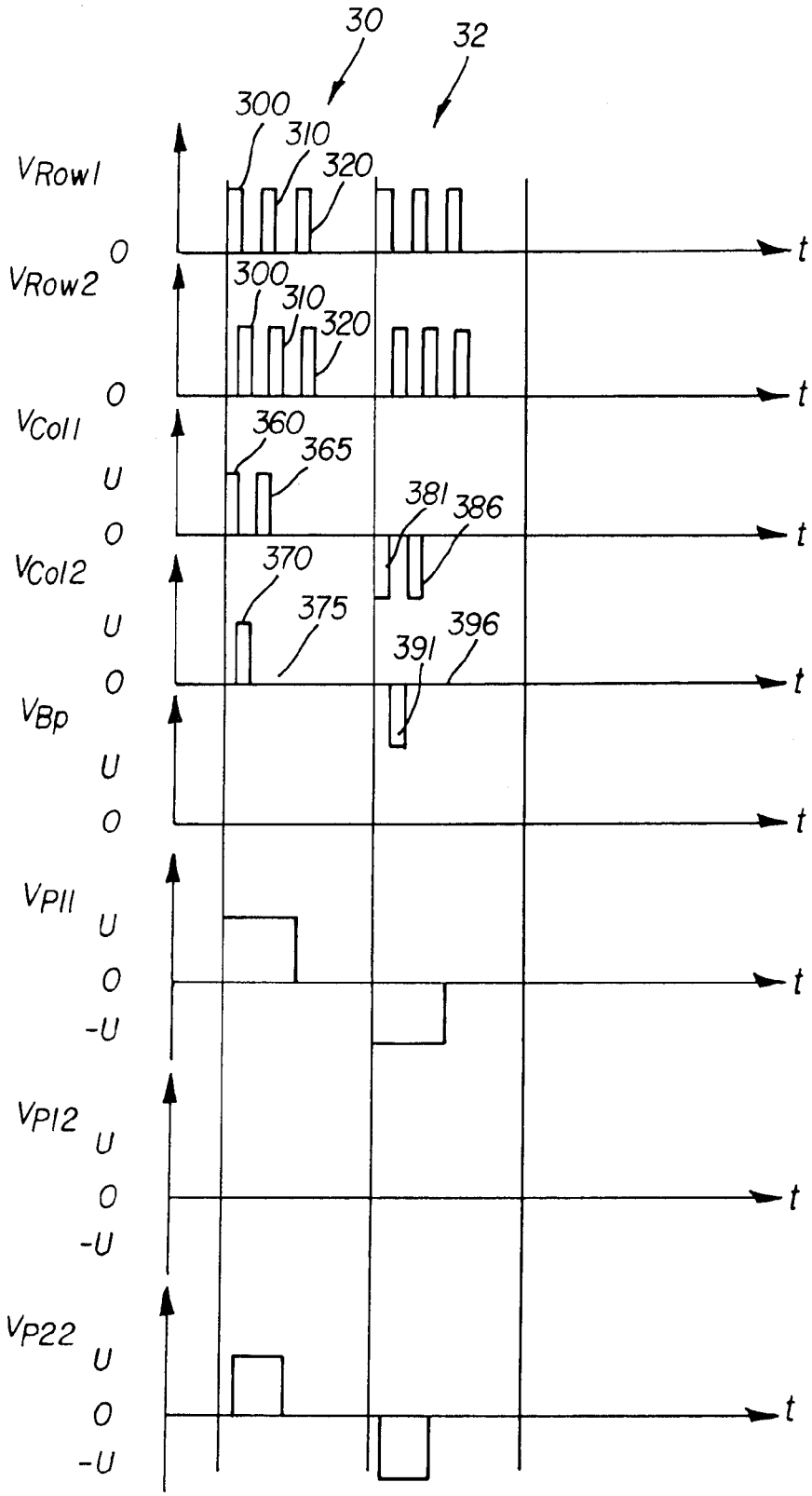
FIG. 3B is a voltage waveform diagram for driving an active matrix cholesteric liquid crystal display according to an alternative embodiment of the present invention.

FIG. 3B shows an alternative embodiment to implement an active matrix addressed cholesteric liquid crystal display drive scheme according to the present invention. This embodiment is identical to the one shown in FIG. 3A in the first frame 30. In the second frame 32, the backplane voltage $V_{Bp}$ is zero. The data voltage waveforms still have two data voltage pulses 381 and 386 for the first optical (planar) state, and two data voltage pulses 391 and 396 for the second optical (focal conic) state. Unlike their counterparts as shown in FIG. 3A, the first data voltage pulses 381 and 391 have a level of −U, and the second data voltage pulses have a level of either −U like data voltage pulse 386 for the planar state, or 0 like the data voltage pulse 396 for the focal conic state. The pixel voltage, however, is identical to that generated in FIG. 3A, being either −U or 0 in the second frame.

Figure 4A:
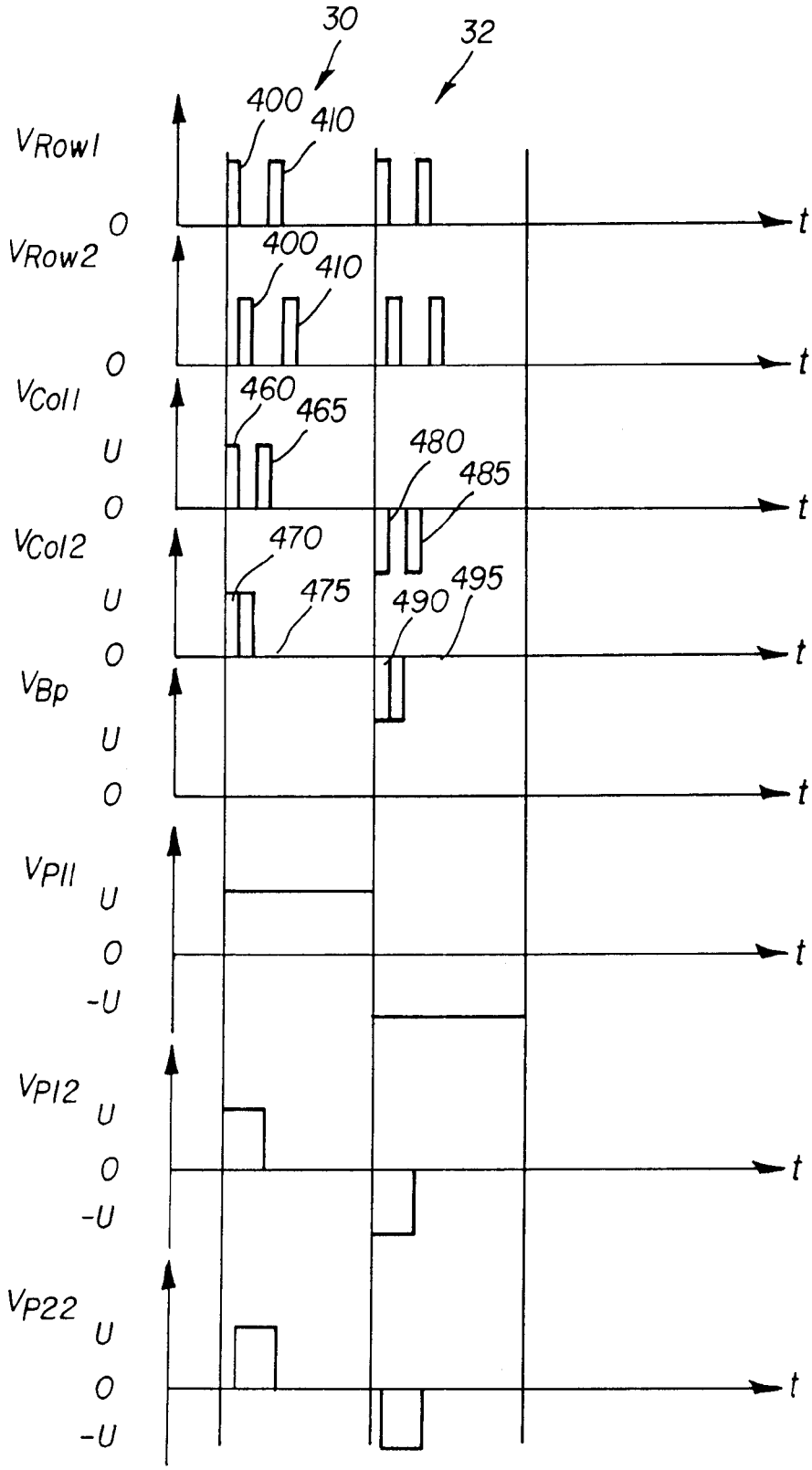
FIG. 4A is a voltage waveform diagram for driving an active matrix cholesteric liquid crystal display according to an alternative embodiment of the present invention.

FIG. 4A shows another alternative embodiment to implement an active matrix addressed cholesteric liquid crystal display drive scheme according to the present invention. First, the select row voltage waveforms $V_{Row1}$ and $V_{Row2}$ have two selected voltage pulses 400 and 410, but do not have a discharge voltage pulse corresponding to the prior art pulse 220 in FIG. 2 or pulse 320 in FIG. 3A. By eliminating the discharge voltage pulse, all pixels regardless of whether they need to be switched will be switched, which may consume more power. However, with this scheme it is possible to generate an on-state pixel voltage such as $V_{P11}$ having a 100% duty cycle, which allows the amplitude of U to be minimized. This may in turn reduce power consumption. The on-state pixel voltage having a 100% duty cycle can be critical to achieve a high reflectance optical state in view of data shown in FIG. 6. Second, the data voltage levels consist of a zero voltage and two non-zero voltages +U and −U. Like the embodiment shown in FIG. 3A, both $V_{Col1}$ and $V_{Col2}$ have first identical voltage pulses 460 and 470, respectively. Second voltage pulse 465 in $V_{Col1}$ has an amplitude of +U, which causes the pixel voltage $V_{P11}$ to be +U with a 100% duty cycle, and results in a planar state. $V_{Col2}$ has the second voltage pulse 475 having an amplitude of 0, causing the pixel voltage $V_{P22}$ to be U with smaller duty cycle and resulting in a focal conic state. Third, the zero voltage is applied to the common electrode, resulting in the backplane voltage $V_{Bp}$ being at 0 volts in both the first frame 30 and the second frame 32.

In the second frame 32, the select voltages $V_{Row1}$ and $V_{Row2}$ are the same as those in the first frame. The data voltage waveforms have two data voltage pulses 480 and 485 for the first optical (planar) state, and two data voltage pulses 490 and 495 for the second optical (focal conic) state, with the first data voltage pulses 480 and 490 being the same as −U, and the second data voltage pulses being either −U like data voltage pulse 485 for the planar state, or 0 like the data voltage pulse 495 for the focal conic state. Unlike in the first frame, the pixel voltage is either −U or 0 in the second frame.

Figure 4B:
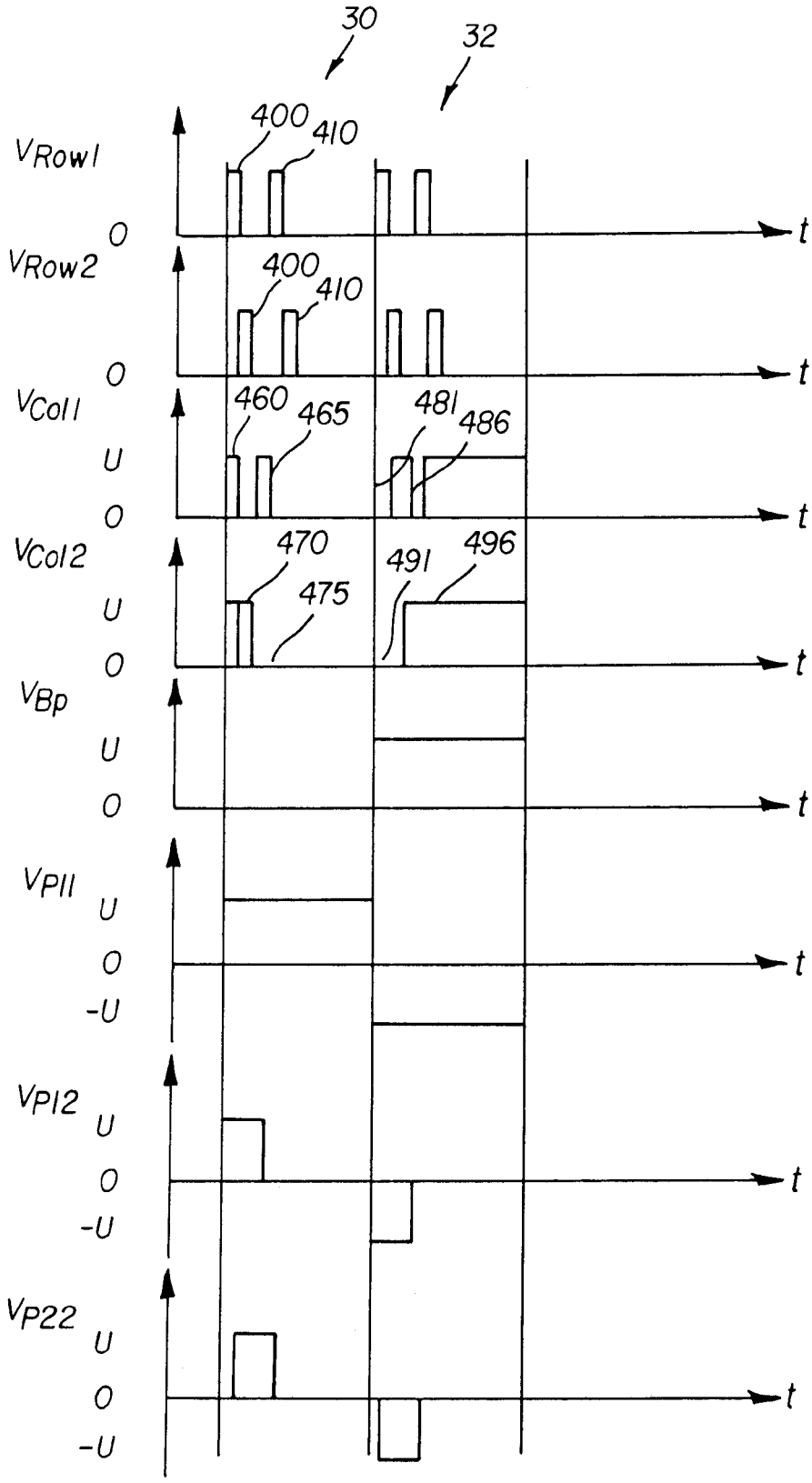
FIG. 4B is a voltage waveform diagram for driving an active matrix cholesteric liquid crystal display according to an alternative embodiment of the present invention.

FIG. 4B shows another alternative embodiment to implement an active matrix addressed cholesteric liquid crystal display drive scheme according to the present invention. This embodiment is identical to the one shown in FIG. 4A in the first frame 30. In the second frame 32, the backplane voltage $V_{Bp}$ is changed to +U from 0. The data voltage waveforms have two data voltage pulses 481 and 486 for the first optical (planar) state, and two data voltage pulses 491 and 496 for the second optical (focal conic) state. Unlike their counterparts as shown in FIG. 4A, the first data voltage pulses 481 and 491 are the same being 0 volts.

The second data voltage pulse 486 has an amplitude of 0 to achieve the planar state, and the second data voltage pulse 496 has an amplitude of U to obtain the focal conic planar state. All of the pixel voltages resulting from the data voltages and the backplane voltage are identical to those generated in FIG. 4A, being either −U or 0 in the second frame.

Circuits and systems for generating voltage waveforms to drive cholesteric liquid crystal displays are well known. Examples are found in U.S. Published patent application No. 2001/0050666 published by Huang et al. on Dec. 13, 2001, which is incorporated herein by reference. Huang et al. provide an active matrix display drive system having data generation drivers that provide pulse trains with more than three different voltage levels to the active pixels. In contrast, the present invention uses data generation drivers to generate only three different pixel voltage levels U, −U or 0.

By adding more select voltage and data voltage pulses in a single frame, it is possible to generate multiple duty cycles to the pixel voltage waveforms, thus multiple gray level cholesteric liquid crystal displays can be achieved with active matrix displays having only three levels 0, +U and −U in the pixel voltages.

The invention has been described in detail with particular reference to certain preferred embodiments thereof, but it will be understood that variations and modifications can be effected within the spirit and scope of the invention.

PARTS LIST

10 data line
12 select line
14 pixel
16 transistor
18 storage capacitor
20 common electrode
30 first frame
32 second frame
200 select voltage pulse
220 discharge voltage pulse
300 first select voltage pulse
310 second select voltage pulse
320 discharge voltage pulse
360 first data voltage pulse in the first frame
365 second data voltage pulse in the first frame
370 first data voltage pulse in the first frame
375 second data voltage pulse in the first frame
380 first data voltage pulse in the second frame
381 first data voltage pulse in the second frame
385 second data voltage pulse in the second frame
386 second data voltage pulse in the second frame
390 first data voltage pulse in the second frame
391 first data voltage pulse in the second frame
395 second data voltage pulse in the second frame
396 second data voltage pulse in the second frame
400 first select voltage pulse
410 second select voltage pulse
460 first data voltage pulse in the first frame
465 second data voltage pulse in the first frame
470 first data voltage pulse in the first frame
475 second data voltage pulse in the first frame
480 first data voltage pulse in the second frame
481 first data voltage pulse in the second frame
485 second data voltage pulse in the second frame
486 second data voltage pulse in the second frame
490 first data voltage pulse in the second frame
491 first data voltage pulse in the second frame
495 second data voltage pulse in the second frame
496 second data voltage pulse in the second frame

What is claimed is:

1. A method of driving an active matrix cholesteric liquid crystal display that includes a matrix of data and select lines and an array of pixels connected to the data and select lines through active switching elements, a pixel being capable of producing two or more gray levels, comprising:

a) providing a select voltage and a plurality of data voltages; and b) during a pixel writing cycle, applying the select voltage and the data voltages to the select and data lines of the display to produce only three pixel voltage levels 0, +U and −U, having respective duty cycles and controlling the duty cycles of the pixel voltage levels to determine the gray levels of the pixels, and wherein the average voltage applied to a pixel during the pixel writing cycle is zero.

2. The method claimed in claim 1, wherein the data voltage levels consist of a zero voltage and a non-zero voltage U.

3. The method claimed in claim 2, wherein the active matrix liquid crystal display further includes a common electrode connected to all of the pixels, and further comprising the step of applying the zero voltage to the common electrode and the voltage U to the data line to generate the pixel voltage U, and applying the voltage U to the common electrode and the voltage to the data line to generate the pixel voltage −U.

4. The method claimed in claim 1, wherein the data voltage levels consist of a zero voltage and two non-zero voltages +U and −U.

5. The method claimed in claim 4, wherein the active matrix liquid crystal display further includes a common electrode connected to all of the pixels, and further comprising the step of applying the zero voltage to the common electrode.

6. The method claimed in claim 1, wherein a pixel writing cycle includes:

a) a selection portion wherein a non zero pixel voltage is applied to any pixels in the display whose state is to be changed; and b) a duty cycle portion wherein the duty cycle of the non zero pixel voltages are determined.

7. An active matrix cholesteric liquid crystal display, comprising:

a) an array of pixels each capable of producing two or more gray levels and a corresponding array of active switching elements;

b) a matrix of data and select lines connected to the pixels through the active switching elements; and c) a driver for applying a select voltage and one of a plurality of data voltages to the select and data lines of the display to produce only three pixel voltage levels 0, +U and −U, having respective duty cycles and controlling the duty cycles of the pixel voltage levels to determine the gray levels of the pixels.

8. The display claimed in claim 7, wherein the data voltage levels consist of a zero voltage and a non-zero voltage U.

9. The display claimed in claim 8, further comprising a common electrode connected to all of the pixels, and wherein the driver applies the zero voltage to the common electrode and the voltage U to the data line to generate the pixel voltage U, and applies the voltage U to the common electrode and the voltage to the data line to generate the pixel voltage −U.

10. The display claimed in claim 7, wherein the data voltage levels consist of a zero voltage and two non-zero voltages +U and −U.

11. The display claimed in claim 10, wherein the active matrix liquid crystal display further includes a common electrode connected to all of the pixels, and wherein the zero voltage is applied to the common electrode.

12. The display claimed in claim 7, wherein the driver drives the pixels during a pixel writing cycle that includes:

a) a selection portion wherein a non zero pixel voltage is applied to any pixels in the display whose state is to be changed; and b) a duty cycle portion wherein the duty cycle of the non zero pixel voltages are determined.

* * * * *